US005553674A

United States Patent [19]

Theurer et al.

[11] Patent Number: 5,553,674

[45] Date of Patent: Sep. 10, 1996

[54] BALLAST CLEANING MACHINE

[75] Inventors: Josef Theurer, Vienna; Herbert Wörgötter, Gallneukirchen; Friedrich Oellerer, Linz, all of Austria

[73] Assignee: Franz Plasser Bahnbaumaschinen--Industriegesellschaft mbH, Vienna, Austria

[21] Appl. No.: 354,635

[22] Filed: Dec. 13, 1994

[30] Foreign Application Priority Data

| | | | |
|---|---|---|---|
| Jan. 5, 1994 | [WO] | WIPO | PCT/AT94/00001 |
| Apr. 7, 1994 | [AT] | Austria | 719/94 |
| Aug. 22, 1994 | [AT] | Austria | 1619/94 |

[51] Int. Cl.[6] ..... E01B 27/10

[52] U.S. Cl. ..... 171/16; 37/104; 104/2

[58] Field of Search ..... 171/16; 37/104; 104/2

[56] References Cited

U.S. PATENT DOCUMENTS

| | | | |
|---|---|---|---|
| 1,329,554 | 2/1920 | Sims | 171/16 X |
| 1,483,674 | 2/1924 | Owen | 171/16 X |
| 2,025,543 | 12/1935 | McWilliams et al. | 171/16 |
| 2,028,688 | 1/1936 | Rugg et al. | 171/16 X |
| 4,450,771 | 5/1984 | Theurer et al. | 171/16 X |
| 5,094,018 | 3/1992 | Theurer et al. | 171/16 X |
| 5,394,944 | 3/1995 | Theurer et al. | 171/16 |

FOREIGN PATENT DOCUMENTS

| | | | |
|---|---|---|---|
| 398096 | 9/1994 | Austria . | |
| 2655669 | 6/1991 | France . | |
| 2226612 | 1/1973 | Germany . | |
| 2136306 | 1/1973 | Germany . | |
| 82 36 650.0 | 6/1983 | Germany . | |
| 573526 | 9/1977 | U.S.S.R. | 171/16 |
| 2172326 | 5/1988 | United Kingdom . | |
| 2270943 | 3/1994 | United Kingdom | 171/16 |
| 2273515 | 6/1994 | United Kingdom | 171/16 |
| 9417245 | 8/1994 | WIPO | 171/16 |

*Primary Examiner*—Terry Lee Melius
*Assistant Examiner*—Christopher J. Novosad
*Attorney, Agent, or Firm*—Collard & Roe, P.C.

[57] ABSTRACT

A ballast cleaning machine comprises a machine frame supported on undercarriages running on the track and carrying a ballast screening arrangement, a ballast excavating device including a revolvable excavating chain arranged to deliver excavated ballast to the screening arrangement for cleaning the excavated ballast, a conveyor arrangement disposed to receive the cleaned ballast from the screening arrangement and to discharge the cleaned ballast for support of the track, a laterally and vertically adjustable suction pipe having a suction opening at one end for receiving ballast, and a vacuum device connected to an opposite end of the suction pipe for applying sub-atmospheric pressure to the suction opening and thereby to suck up ballast through the suction pipe.

11 Claims, 2 Drawing Sheets

BALLAST CLEANING MACHINE

BACKGROUND OF THE INVENTION

1. Field of the Invention

The present invention relates to a machine for cleaning ballast supporting a track, which comprises a machine frame supported on undercarriages running on the track and carrying a ballast screening arrangement, a ballast excavating device including a revolvable excavating chain arranged to deliver excavated ballast to the screening arrangement for cleaning the excavated ballast, and a conveyor arrangement disposed to receive the cleaned ballast from the screening arrangement and to discharge the cleaned ballast for support of the track.

2. Description of the Prior Art

A variety of such ballast cleaning machines are well known. U.S. patent application Ser. No. 08/036,712, filed Mar. 25, 1993, now U.S. Pat. No. 5,394,944, for example, discloses a track-bound ballast cleaning machine with an elongated machine frame which carries a vertically adjustable ballast excavating device. This device includes an endless excavating chain comprising a transversely extending strand which moves during operation underneath the track, excavates ballast and conveys it to a screening arrangement. The screening arrangement separates the detritus from the excavated ballast and conveys it to a forward end of the machine while the cleaned ballast is deposited by a conveyor arrangement underneath the track for support thereof. Instead and/or additionally, more clean ballast or other track bed bulk material may be conveyed from the rear end of the machine and may be discharged on the exposed sub-grade. At the beginning of the operation of such known ballast cleaning machines, a gap must be excavated in the ballast bed to enable the transversely extending excavating chain strand to be introduced underneath the track.

German patent No. 2,226,612 discloses a ballast cleaning machine which comprises a respective excavating device at each side of the machine frame and track rail. Each excavating device comprises a beam about which an endless excavating chain revolves, and each beam is rotatable about a vertical axis extending at one end of the beam and is vertically adjustable. For excavating ballast under the track, the beams are lowered onto the track shoulders and are rotated inwardly to extend below the track. Upon revolution of the excavating chains, the ballast is excavated and conveyed to the track shoulders where upwardly inclined bucket elevators convey the excavated ballast to a screening arrangement for cleaning.

It is also known to remove ballast from a track bed by suction. Such a machine has been disclosed in British patent No. 2,172,326. This machine comprises three suction pipes spaced from each other in a transverse direction to aspire ballast from the two shoulders and the center of the ballast bed. Rotatable scarifying tools are attached to the suction pipe ends having the suction openings to scarify encrusted ballast before it is aspired. The cleaned ballast is returned to the track.

Other machines using suction for removing ballast from a track have been disclosed in German patent No. 2,136,306 and German utility model No. G 8,236,650.0.

SUMMARY OF THE INVENTION

It is the primary object of this invention to improve a ballast cleaning machine of the first-described type in such a manner that it retains its proven basic structure while being operable in a more rational way under a variety of operating conditions.

The above and other objects are accomplished by the invention by equipping such a machine with a laterally and vertically adjustable suction pipe having a suction opening at one end for receiving ballast, and a vacuum device connected to an opposite end of the suction pipe for applying sub-atmospheric pressure to the suction opening and thereby, to suck up ballast through the suction pipe.

Such a ballast cleaning machine makes it possible considerably to accelerate the execution of the initial steps required for operating the machine, particularly as far as the removal of ballast for creating the ballast bed gap required for the insertion of the transverse excavating chain strand under the track is concerned. This ballast removal may now be effectuated without any manual labor, rapidly and without any problems by aspiring the ballast through the suction pipe. The removed ballast may be stored on the machine and need not be deposited on the track shoulders or conveyed away from the machine. Retrofitting existing ballast cleaning machines of this type with a suction apparatus of the present invention is quite simple and relatively inexpensive.

According to a preferred feature, the machine frame further carries an operator's cab spaced from ballast excavating device in a longitudinal direction, the suction pipe opening being disposed between the cab and the excavating device. This has the ergonomic advantage of enabling the operating drives to be remote-controlled, and the operating personnel in the cab is protected from any danger from train traffic on a neighboring track.

According to a preferred embodiment, the revolvable excavating chain comprises a detachable strand extending adjacent the suction opening transversely to the track and disposable underneath the track during operation of the machine. This makes a particularly rational and time-saving preparation of the machine for its work possible. The transverse chain strand may thus be attached immediately upon creation of the gap in the ballast bed by the aspiration of the ballast through the suction pipe so that it is disposed below the track, and no repositioning of the machine is required for this purpose. The environmentally favorable aspiration of the ballast also eliminates the dust conditions attending the conventional ballast excavation required to form the necessary ballast bed gap.

Preferably, the machine frame further carries a horizontal guide track extending transversely to the track, and a carrier for the suction pipe arranged above the suction opening, the carrier being displaceable along the guide track. The carrier may be telescopingly vertically retractible and extensible, and the machine may further comprise a drive for telescopingly retracting and extending the carrier. This arrangement not only facilitates the creation of the required ballast bed gap at the beginning of the operation but also makes it possible to use the machine in track sections where various obstacles, such as encountered in track switches, make the use of the excavating chain impossible. This also holds for track sections along station platforms where the suction pipe may be used in the narrow space between the track and the edge of the platform to remove ballast.

The suction pipe end having the suction opening is preferably rotatable about a vertically extending axis, and the machine further comprises a drive for rotating the one suction pipe end. Also, the one suction pipe end preferably has finger-shaped scarifying elements projecting downwardly from the suction opening.

The efficiency of the ballast cleaning machine will be doubled if the machine comprises two suction pipes spaced from each other in a direction extending transversely to the track, and the machine frame further carries a carrier for each of the suction pipes arranged above the suction opening, each carrier being vertically adjustable. A respective pivot links each carrier to the machine frame, each pivot extends in a longitudinal direction and supports a respective carrier for swinging about a longitudinally extending pivot axis, and the pivots being spaced from each other by a distance substantially corresponding to the gage of the track.

The aspired ballast, which has been purged by the flow of the suction air through the pipe, may be readily returned to the track if the machine frame further carries a ballast storage bin arranged to receive sucked-up ballast from the suction device, the storage bin having a closable ballast discharge opening arranged above the track.

Finally, the machine may further comprise an air compressor device connected to the ballast storage bin, and a blow piping arranged between the storage bin and the screening arrangement for conveying ballast from the storage bin to the screening arrangement. This makes it possible to empty the storage bin into the screening arrangement so that the ballast may be fully cleaned without the necessity to convey the excavated ballast, together with the detritus coming from the screening arrangement, to the machine end for removal.

BRIEF DESCRIPTION OF THE DRAWING

The above and other objects, advantages and features of the present invention will become more apparent from the following detailed description of certain now preferred embodiments thereof, taken together with the accompanying, somewhat schematic drawing wherein FIGS. 1 and 2, taken together, show a side elevational view of a ballast cleaning machine according to this invention.

DETAILED DESCRIPTION OF THE PREFERRED EMBODIMENTS

Figure 1:
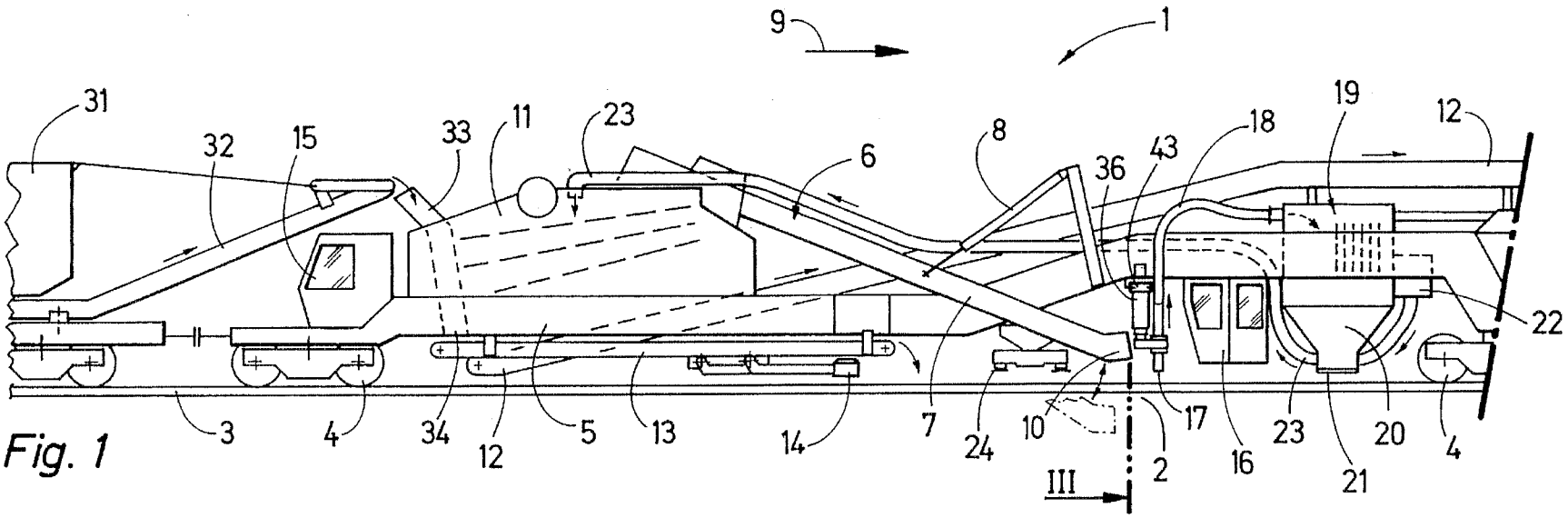
Figure 2:
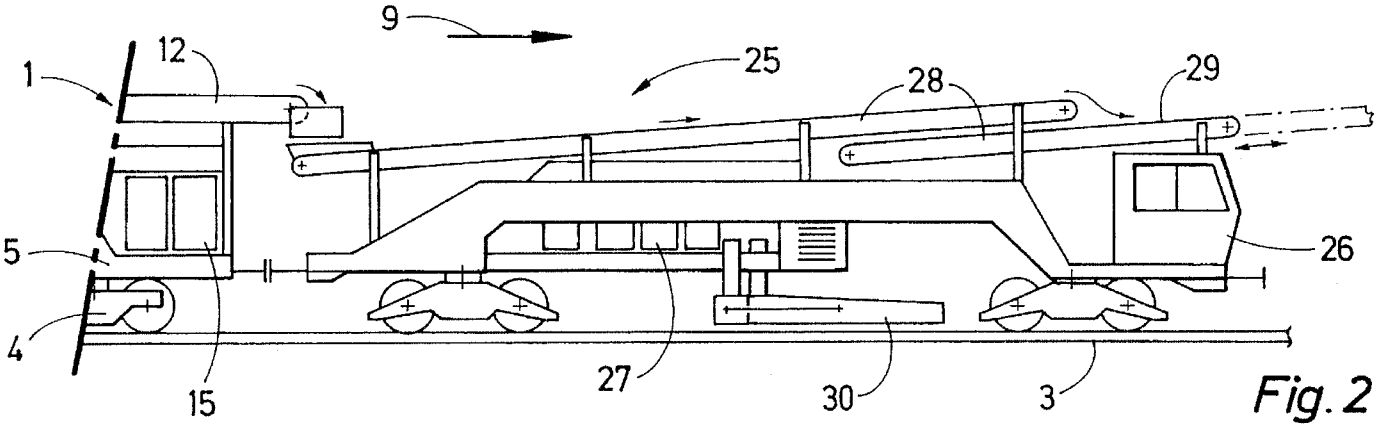

Referring now to the drawing and first to FIGS. 1 and 2, there is shown a machine 1 for cleaning ballast 2 supporting a track 3. The machine comprises machine frame 5 supported on undercarriages 4 running on the track. The machine frame carries ballast screening arrangement 11, and also ballast excavating device 6 substantially centrally between undercarriages 4. The ballast excavating device includes revolvable excavating chain 7 running in a trough-shaped guide and arranged to deliver excavated ballast to screening arrangement 11 for cleaning the excavated ballast. This well known type of ballast excavating device is laterally and vertically adjustable by drives 8 linking device 6 to machine frame 5. Revolvable excavating chain 7 comprises detachable strand 10 extending transversely to track 3 and parallel to the track plane. The detachable portion of the trough-shaped guide holding detachable chain strand 10 is disposable underneath track 3 during operation of the machine. The track is raised and held in its raised position during the ballast cleaning operation by vertically adjustable track lifting unit 24. Ballast excavating chain 7 in its trough-shaped guide rises obliquely towards screening arrangement 11 and the excavated ballast in the trough-shaped guide is conveyed by the revolving excavating chain upwardly towards an end of the chain opposite transverse chain strand 10 to be discharged into the screening arrangement.

The detritus is separated from the excavated ballast in screening arrangement 11, falls on conveyor band 12 and is conveyed forwardly to a front end of machine frame 5, as seen in the operating direction of machine 1, which is indicated by arrow 9. Conveyor arrangement 13 is disposed to receive the cleaned ballast from screening arrangement 11 and to discharge the cleaned ballast for support of the track. The cleaned ballast may then be smoothed by vertically adjustable ballast bed planing device 14. Driver's cabs 15 are mounted on machine frame 5 at opposite ends of the machine frame, and operator's cab 16 is mounted on the machine frame within sight of transversely extending excavating chain strand 10 and spaced therefrom in the longitudinal direction.

According to the present invention, laterally and vertically adjustable suction pipe 18 having suction opening 17 at one end is disposed between operator's cab 16 and excavating device 6 for receiving ballast from ballast bed 2, and vacuum device 19 is carried on machine frame 5 and is connected to an opposite end of suction pipe 18 for applying sub-atmospheric pressure to suction opening 17 and thereby to suck up ballast through the suction pipe. The machine frame further carries ballast storage bin 20 arranged to receive sucked-up ballast from the suction device. The storage bin has closable ballast discharge opening 21 arranged above track 3. Air compressor device 22 is connected to ballast storage bin 20, and blow piping 23 is arranged between the storage bin and screening arrangement 11 for conveying ballast from storage bin 20 to screening arrangement 11.

As shown in FIG. 2, locomotive 25 is coupled to the front end of ballast cleaning machine 1 and is equipped with driver's cab 26, motor 27 and vertically and laterally adjustable shoulder plow 30. Locomotive 25 also carries longitudinally extending conveyor band 28 and the forward end of conveyor band 12 overlaps a rear end of conveyor band 28 to receive the detritus. Furthermore, telescopingly extensible and retractable conveyor band 29 is mounted at the front end of the locomotive so that conveyor bands 12, 28 and 29 form a continuous conveyor arrangement for the conveyance of the detritus coming from screening arrangement 11. When the machine is moved from one operating site to another, conveyor band 29 is retracted. In operation, it is extended to discharge the detritus. As shown in FIG. 1, bulk material transport car 31 is coupled to the rear end of machine 1 and transfer conveyor band 32 is arranged to convey bulk material, such as clean ballast or sand, from car 31 to a funnel 33 arranged on screening arrangement 11. The funnel has outlet port 34 arranged to deliver the bulk material to conveyor arrangement 13. This arrangement serves to deliver a layer of sand to the exposed subgrade, if desired, or to provide additional clean ballast, if needed.

Figure 3:
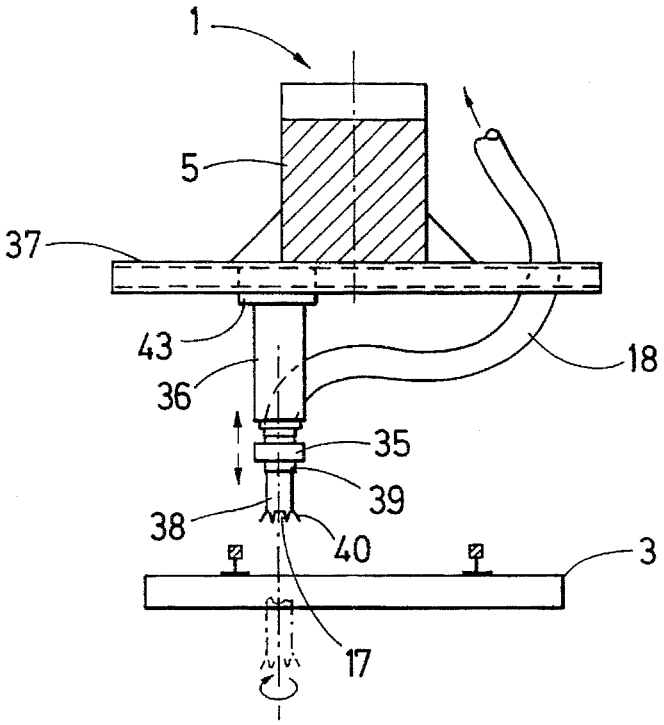
FIG. 3 is a fragmentary end view, partly in a section taken along line III of FIG. 1, showing one embodiment of a suction pipe arrangement.

As shown in FIG. 3, machine frame 5 further carries horizontal guide track 37 extending transversely to track 3, and a carrier 35 for suction pipe 18 is arranged above suction opening 17, the carrier being displaceable along the guide track. The carrier is telescopingly vertically retractible and extensible, as indicated by the double-headed arrow in FIG. 3, and drive 36 is arranged for telescopingly retracting and extending carrier 35. Drive 43 is arranged to displace the vertically adjustable carrier transversely along horizontal guide track 37 so that suction pipe 18 with its suction opening 17 is vertically and transversely adjustable for operating over the entire ballast bed 2.

The one suction pipe end 38 having suction opening 17 is rotatable about a vertically extending axis (see circular arrow in FIG. 3), and drive 39 is arranged for rotating the one suction pipe end. Furthermore, the one suction pipe end 38 has finger-shaped scarifying elements 40 projecting downwardly from suction opening 17.

Figure 4:
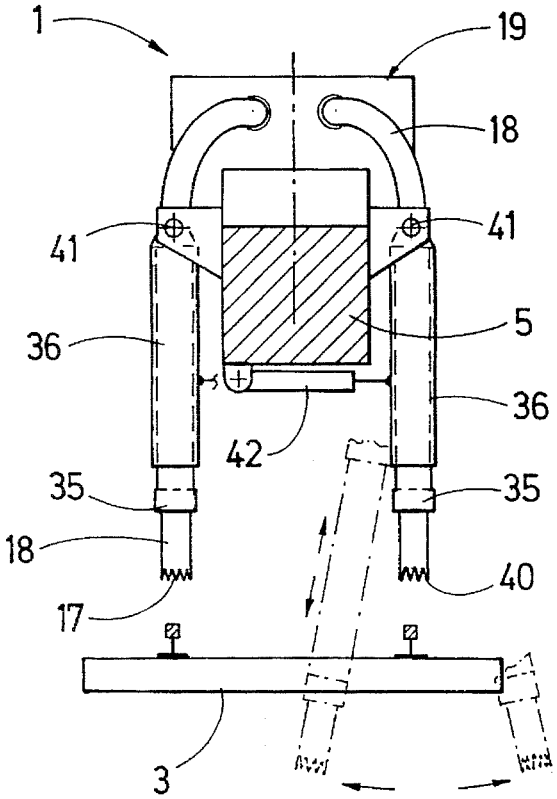
FIG. 4 is a like view, showing another embodiment of the suction pipe arrangement.

FIG. 4 shows another embodiment comprising two suction pipes 18 spaced from each other in a direction extending transversely to track 3. Identical reference numerals have been applied to identically functioning parts in FIGS. 3 and 4 to obviate redundancy in the description. As illustrated in FIG. 4, machine frame 5 carries a carrier 35 for each suction pipe 18 arranged above suction opening 17, each carrier being vertically adjustable, as described in connection with FIG. 3. Respective pivot 41 links vertical adjustment drive 36 of each carrier 35 to machine frame 5, each pivot extending in a longitudinal direction and supporting a respective carrier 35 for swinging about a longitudinally extending pivot axis. Pivots 41 are spaced from each other by a distance substantially corresponding to the gage of track 3. Drive 42 is linked to each suction pipe carrier 35 for swinging the carriers about the pivot axis.

What is claimed is:

1. A machine for cleaning ballast supporting a track, which comprises a machine frame supported on undercarriages running on the track and carrying (b) a ballast screening arrangement, (c) a ballast excavating device including a revolvable excavating chain arranged to deliver excavated ballast to the screening arrangement for cleaning the excavated ballast, (d) a conveyor arrangement disposed to receive the cleaned ballast from the screening arrangement and to discharge the cleaned ballast for support of the track, (e) a laterally and vertically adjustable suction pipe having a suction opening at one end for receiving ballast, and (f) a vacuum device connected to an opposite end of the suction pipe for applying sub-atmospheric pressure to the suction opening and thereby to suck up ballast through the suction pipe.

2. The ballast cleaning machine of claim 1, wherein the machine frame further carries an operator's cab spaced from the ballast excavating device in a longitudinal direction, the suction pipe opening being disposed between the cab and the excavating device.

3. The ballast cleaning machine of claim 1, wherein the revolvable excavating chain comprises a detachable strand extending adjacent the suction opening transversely to the track and disposable underneath the track during operation of the machine.

4. The ballast cleaning machine of claim 1, wherein the machine frame further carries a horizontal guide track extending transversely to the track, and a carrier for the suction pipe arranged above the suction opening, the carrier being displaceable along the guide track.

5. The ballast cleaning machine of claim 4, wherein the carrier is telescopingly vertically retractible and extensible, and further comprising a drive for telescopingly retracting and extending the carrier.

6. The ballast cleaning machine of claim 1, wherein the one suction pipe end having the suction opening is rotatable about a vertically extending axis, and further comprising a drive for rotating the one suction pipe end.

7. The ballast cleaning machine of claim 1, wherein the one suction pipe end having the suction opening has finger-shaped scarifying elements projecting downwardly from the suction opening.

8. The ballast cleaning machine of claim 1, comprising two suction pipes spaced from each other in a direction extending transversely to the track, and the machine frame further carries a carrier for each suction pipe arranged above the suction opening, each carrier being vertically adjustable.

9. The ballast cleaning machine of claim 1, wherein the machine frame further carries a ballast storage bin arranged to receive sucked-up ballast from the vacuum device, the storage bin having a closable ballast discharge opening arranged above the track.

10. A machine for cleaning ballast supporting a track, which comprises a machine frame supported on undercarriages running on the track and carrying (b) a ballast screening arrangement, (c) a ballast excavating device including a revolvable excavating chain arranged to deliver excavated ballast to the screening arrangement for cleaning the excavated ballast, (d) a conveyor arrangement disposed to receive the cleaned ballast from the screening arrangement and to discharge the cleaned ballast for support of the track, (e) two laterally and vertically adjustable suction pipes spaced from each other in a direction extending transversely to the track, each suction pipe having a suction opening at one end for receiving ballast, (f) a carrier for each suction pipe arranged above the suction opening, each carrier being vertically adjustable, (1) a respective pivot linking each carrier to the machine frame, each pivot extending in a longitudinal direction and supporting a respective one of the carriers for swinging about a longitudinally extending pivot axis, the pivots being spaced from each other by a distance substantially corresponding to the gage of the track, and (2) drive means for swinging the carriers about each pivot axis, and (g) a vacuum device connected to an opposite end of each suction pipe for applying sub-atmospheric pressure to each suction opening and thereby to suck up ballast through each suction pipe.

11. A machine for cleaning ballast supporting a track, which comprises a machine frame supported on undercarriages running on the track and carrying (b) a ballast screening arrangement, (c) a ballast excavating device including a revolvable excavating chain arranged to deliver excavated ballast to the screening arrangement for cleaning the excavated ballast, (d) a conveyor arrangement disposed to receive the cleaned ballast from the screening arrangement and to discharge the cleaned ballast for support of the track, (e) a laterally and vertically adjustable suction pipe having a suction opening at one end for receiving ballast, (f) a vacuum device connected to an opposite end of the suction pipe for applying sub-atmospheric pressure to the suction opening and thereby to suck up ballast through the suction pipe, (g) a ballast storage bin arranged to receive sucked-up ballast from the vacuum device, the storage bin having (1) a closable ballast discharge opening arranged above the track, (h) an air compressor device connected to the ballast storage bin, and (i) a blow piping arranged between the storage bin and the screening arrangement for conveying ballast from the storage bin to the screening arrangement.

* * * * *